US006247680B1

(12) United States Patent
Cohen

(10) Patent No.: US 6,247,680 B1
(45) Date of Patent: Jun. 19, 2001

(54) CABLE HOIST CONTROLLER

(76) Inventor: Abraham Cohen, c/o M. K. Silverman, 1 Gateway Center, #2600, Newark, NJ (US) 07102-5397

( * ) Notice: Subject to any disclaimer, the term of this patent is extended or adjusted under 35 U.S.C. 154(b) by 483 days.

(21) Appl. No.: 08/692,761

(22) Filed: Aug. 6, 1996

(51) Int. Cl.[7] ..... B66D 1/28
(52) U.S. Cl. ..... 254/333
(58) Field of Search ..... 254/333

(56) References Cited

U.S. PATENT DOCUMENTS

| | | | | |
|---|---|---|---|---|
| 2,881,029 | | 4/1959 | Tollefsen | 182/14 |
| 3,110,199 | | 11/1963 | Lilly . | |
| 3,231,240 | * | 1/1966 | Naito | 254/333 |
| 3,721,426 | * | 3/1973 | Kaufer | 254/333 |
| 3,949,969 | | 4/1976 | Kaufer . | |
| 4,139,178 | * | 2/1979 | Hippach | 254/333 |
| 4,555,091 | * | 11/1985 | May et al. | 254/333 |
| 5,082,248 | * | 1/1992 | Harig | 254/333 |

OTHER PUBLICATIONS

TIRAK Product Literature. Grip Hoist Inc., Westwood, Mass., no date available.
PCI Product Literature. Power Climber, Inc., Los Angeles, CA., no date available.

* cited by examiner

*Primary Examiner*—Katherine A. Matecki
(74) *Attorney, Agent, or Firm*—M K Silverman

(57) ABSTRACT

A cable hoist controller used with mechanized multi-story scaffolding includes a load-bearing support plate and a prime mover secured to the support plate, the prime mover having a rotational power output shaft in direct mechanical communication with an angular velocity modification gear. The controller also includes a primary gear in driven gear relationship with the velocity modification gear, and journalled to the support plate; and a driving sheave having an axial width and further having a circumferential surface including a circumferential cable-receiving groove, the sheave journalled upon a common axis of rotation of both the primary gear and the sheave, the sheave secured in fixed rotational relationship with the primary gear. Also included is a cable situated within the cable-receiving groove of the sheave and a sequence of rollers, each having a circumferential cable-receiving groove. A sequence of roller is disposed about the circumferential surface of the driving sheave, and is in mechanical communication with the cable. A linkage system connects each of the rollers to each other, in which at least one link of the system is selectably detachably removable from a communicating roller. The controller also includes an input roller at one end of the linkage system for feeding of the cable between opposing cable receiving grooves of the sheaves and rollers. Placement of the cable between the sheave and the rollers is facilitated by removal of one of the linkage sequence. Traction of the cable against the cable receiving groove of the sheave will increase as a function of in the weight of the load on the load-bearing plate of the cable controller.

8 Claims, 3 Drawing Sheets

CABLE HOIST CONTROLLER

BACKGROUND OF THE INVENTION

The present invention relates to wire cable winch hoist controllers used with multi-story scaffolding and, more specifically, to such hoist controllers in which any segment of the cable used therewith may be positioned within the mechanism thereof when the initial assembly of a hoist system occurs at a work site.

While cable winches and controllers therefore are well known in the art as, for example, is reflected in U.S. Pat. No. 5,288,029 (1959) to Tollefsen, entitled Portable Scaffolding; U.S. Pat. No. 3,110,199 (1963) to Lilly, entitled Hoist Controller; and U.S. Pat. No. 3,949,969 (1976) to Kaufer, entitled Cable Winch, an area of inconvenience which is common to these, and other prior art (for example the TIRAK product of Grip Hoist, Inc. and the PC1 product of Power Climber Inc.), is that, in the setting-up and positioning, of the cable hoist controller at a work site, which typically comprises a multi-story structure of between four and dozens of floors, requires that one end of the wire cable of the hoist system be threaded into circumferential grooves which exist upon the driving sheaves which constitute the internal gear and pulley system which substantially all cable hoist controllers, in one configuration or another, use in the elevation and descent of suspended scaffolding, staging and the like.

Therefore, while prior art systems are satisfactory in their operation, once they have been properly set-up, it has been found by the within inventor that the period of time required to accomplish set-up of a cable winch and its associated controller for use with suspended scaffolding or staging can be substantially reduced with a system in which it is not necessary to begin the set-up process with the use of one of the ends of the cable used with the hoist system. The present invention may thereby be viewed as one that can be assembled on site with the use of any segment of the lifting cable that is accessible to the operator.

A further deficiency in the prior art to which the present invention responds is the use of drums upon which a wire cable is wound. After such a cable has been fully, or even partially wound upon a drum, the resultant weight is considerable, thereby impacting upon the safety and convenience in the use of such systems. The instant invention dispenses entirely with the use of any drum and with the use of any type of element which accumulates the wire cable thereon.

Further, the prior art of non-drum systems makes use of typically three sheaves in a controller. The present invention requires only one sheave because of the enhanced traction and safety factors associated therewith.

SUMMARY OF THE INVENTION

The instant invention pertains to a wire cable hoist controller, of a type used with mechanized multi-story scaffolding, in which said controller includes a load-bearing support plate and a prime mover, such as an electric motor, secured to said plate, said prime mover having a rotational power output shaft in integral communication with an angular velocity reduction gear. A primary gear for the hoist controller is provided in driven gear relationship with said reduction gear. Further provided is a driving sheave, which includes a circumferential surface thereof having a cable-receiving groove, in which an axis of rotation of said sheave is secured to an axis of rotation of said primary gear, thereby assuring that said sheave will rotate synchronously with said primary gear. Further provided is wire cable means which are disposable within said cable-receiving groove, of said sheave. Also provided is a plurality of rollers, each having a circumferential cable receiving groove, each roller generally proportioned in axial width to the width of said driving sheave, and each roller having an axial channel therethrough. There is further provided a corresponding plurality of opposing pairs of linkage means comprising means for connection of said rollers to each other. Said linkage means include a corresponding plurality of pairs of bar elements and axles at each end of each pair of bar elements, each axle extending through each of said axial channels of said rollers into opposing sides of each end of said bar elements. Also provided are means for anchoring a first end of said plurality of linkage means to said load-bearing support plate. The hoist controller further includes an input roller, at an input end of said plurality of linkage means, for facilitating feeding of said wire cable means between opposing cable receiving grooves of said sheaves and said rollers. Placement of any segment of said cable means between the respective circumferential grooves of said sheaves and said passive rollers is facilitated by means for selectably detachably securing one of a pair of bar elements connecting said input roller to a first of said plurality of rollers. Thereby, any segment of the cable means may be manually inserted between said opposing-cable receiving grooves of said sheave and rollers by the release of said detachable securing means, i.e., one of said pair of bar elements. Through attachment of the load of the hoist controller to said support plate, said wire cable means is increasingly tensioned as a function of increase in weight of the load or force thereon.

It is, accordingly, an object of the present invention to provide a cable hoist controller in which the usage thereof in connection with scaffolding or staging may be set-up utilizing any segment of a cable of a mechanized hoist which is convenient to the operator thereof.

It is another object to provide a cable hoist controller for use with scaffolding, staging and the like that is easier, more convenient and more cost-effective to assemble upon a multi-story work site than corresponding cable hoist controllers known in the art.

It is a further object of the invention to provide a cable hoist controller in which any segment of the cable thereof may be inserted into the hoist controller.

It is a still further object to provide a hoist controller of the above type which is able to provide greater traction to the cable and therefore increase its load-carrying capability over prior art hoist controllers.

It is a yet further object to provide a single sheave, non-drum, hoist controller having improved traction and gripping of wire cables used therewithin.

The above and yet other objects and advantages of the present invention will become apparent from the hereinafter set forth Brief Description of the Drawings, Detailed Description of the Invention, and Claims appended herewith.

DETAILED DESCRIPTION OF THE INVENTION

Figure 2:
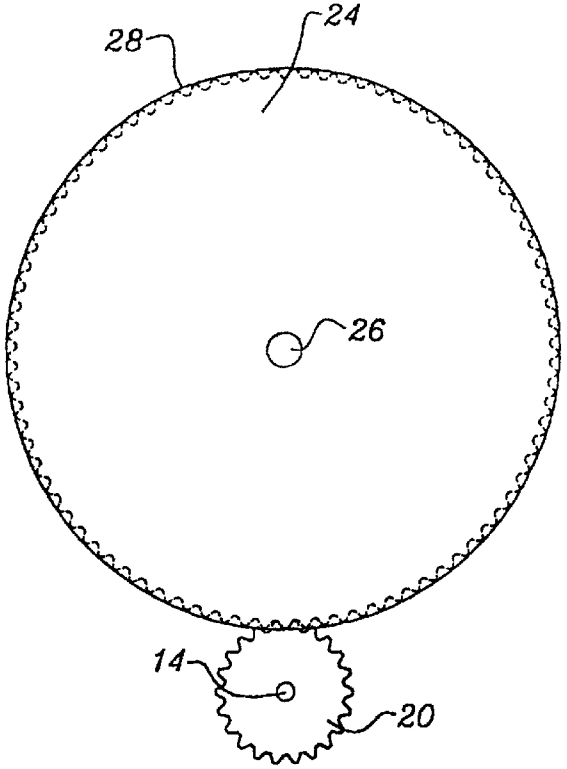
FIG. 2 is a right side plan view of the gear and sheave portions of FIG. 1.
Figure 1:
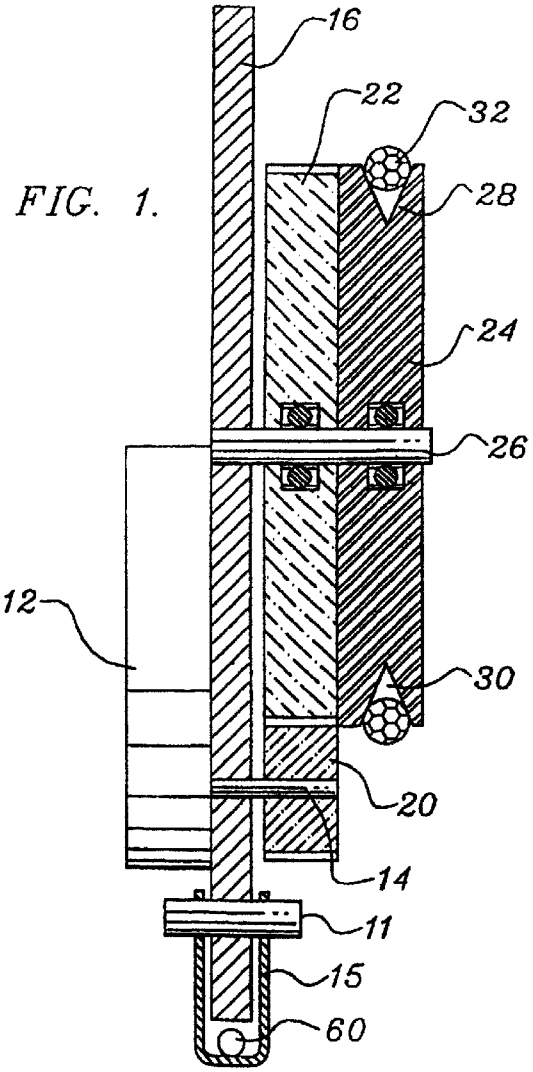
FIG. 1 is an axial cross-sectional view of the inventive cable hoist controller, taken through the axis of rotation of the driving sheave and primary gear thereof.

With reference to the axial cross-sectional view of FIG. 1 and plan view of FIG. 2, the present cable hoist controller may be seen to include a load-bearing plate 16 to which is secured a prime mover such as an electrical motor 12. Also secured to plate 16 is load-bearing pin 11 which is connected to load 60 thru coupling 15. Said motor 12 includes a power output shaft 14 which passes through said plate 16. At a distal end of power shaft 14 is provided an angular velocity modification or reduction gear 20 which gear is in drive gear relationship to a driven primary gear 22. To the right of primary gear 22 is shown a driving sheave 24 which occupies a common axis of rotation 26 with said primary gear 22 and is thereby secured in fixed angular rotational relationship to the primary gear 22.

Provided upon an outer surface 28 of the driving sheave 24 is a circumferential groove 30 which is proportioned for tractional engagement of wire cable means 32.

Figure 3:
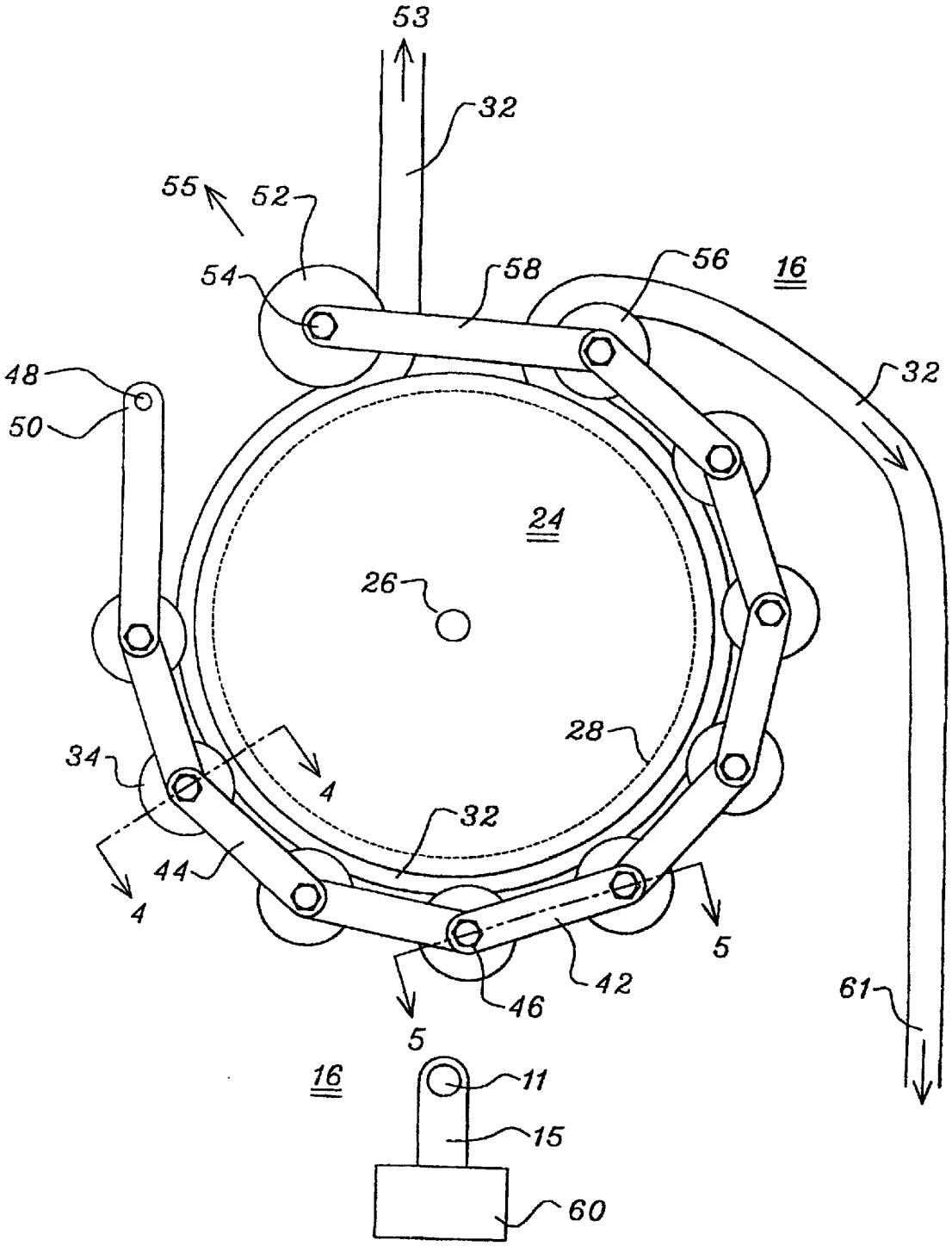
FIG. 3 is a radial schematic view taken through the axial center of the driving sheave of the hoist controller, said view also showing the load and load-bearing pin relative to the support plate.
Figure 4:
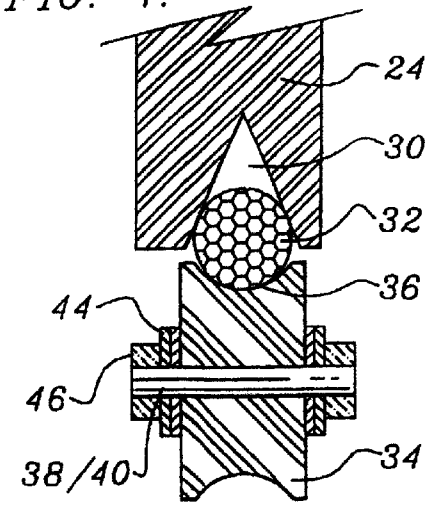
FIG. 4 is a radial cross-sectional view taken along Line 4—4 of FIG. 3.
Figure 5:
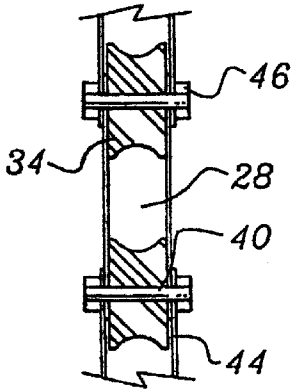
FIG. 5 is a tangential cross-sectional view taken along Line 5—5 of FIG. 3.

With reference to the radial schematic view of FIG. 3, there may be seen a plurality of passive rollers 34, each having a circumferential cable receiving groove 36 (see FIG. 4). As may be noted in the views of FIGS. 4 and 5, the axial width of each roller 34 is generally proportioned to the axial width of the driving sheave 24. Further, each roller 34 is provided with an axial channel 38 through which is positioned an axle 40 of linkage means 42 which means, more specifically, includes bar elements 44 which, as may be noted in the view of FIG. 5, comprise opposing pairs of such elements which connect to each opposite end of axles 40. More particularly, at least one end of each axle 40 of rollers 34, is provided means 46 for selectably detachably securing at least one opposing end of said pairs of bar elements 44 from the ends of the axles 40. Means 46 may be in the nature of a wing or lug nut provided at each end of axles 40 to secure the ends of the bar elements 44 thereto. Said bar elements may comprise chain links.

With further reference to FIG. 3, the present system may also be seen to include an anchor 48 by which end 50 of the linkage means 44 is secured to said support plate 16 of the controller. Also secured to the support plate 16 is said load-bearing pin 11 and, thereto, said coupling 15 and the load 60. Therefore, load 60 will impart a tension to wire cable means 32 which tension will increase as a function of increase in weight of the load or force thereupon. Hence, the greater the load, the greater the tension (indicated by the arrow 53 in the cable means) and, also, the greater the traction against said circumferential groove 30 of the sheave 24.

The inventive cable hoist controller may thereby be seen to function in the fashion of a lasso or cowboy knot in that the heavier is load 60 (secured to plate 16), the greater will be the resultant tension in cable 32, and therefore the greater will be the force with which passive rollers 34 press cable 32 into groove 30 of circumferential surface 28 of the driving sheave 24 and into the circumferential grooves 36 within the passive rollers 34. As such, the traction developed against the respective circumferential grooves 30 and 36, and the cable will be considerable, particularly, as the level of load 60, attached to the support plate 16, increases. As a further result of such traction in the instant system, it is possible to reduce the number of sheaves which are typically required in a cable hoist controller, to a single sheave, this in distinction to the multi-sheave systems presently used in the art.

Further shown in FIG. 3 is an input roller 52 having an axle 54 which is joined to first passive roller 56 through a pair of rigid bars 58. It is, accordingly, to be appreciated that wire cable means 32 may be positioned within circumferential groove 30 of driving sheave 24 by simply removing one of the bar 58 between input roller 52 and first roller 56. Once roller 52 is removed any segment of wire cable 32 may be positioned between the sleeve 24 and rollers 34.

The within inventor has also discovered that the triangular groove 30, shown in radial cross-section in FIGS. 1 and 4, facilitates a high level of traction of cable 32 against the driving sheave. It has, more particularly, been discovered that the apex of this triangle is optimally about thirty degrees, within a range of 20 to 40 degrees. Such a high level of traction arises as a result of the aggregate effect of all rollers against said groove or geometry of sheave 24 which permits wire cable 32 to be forced deeply thereinto as force is transmitted from load 60. It is therefore to be understood that such increase in load causes roller 52 to pull all chain links 58 in direction 55 against sheave 24 thereby squeezing cable means 32 into the sheave grooves.

It is noted that a spool (not shown) may be provided at end 61 of cable means 32 to limit any unwanted movement thereof. (See FIG. 3).

Figure 6:
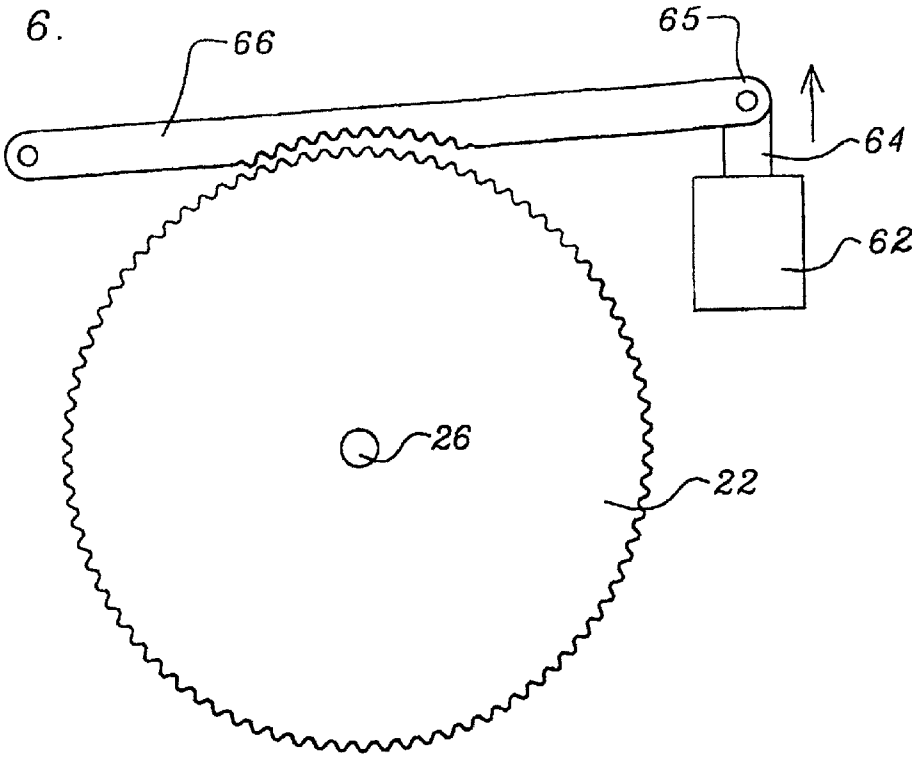
FIG. 6 is a radial schematic view of an emergency brake system adapted for use with the present hoist controller.

In FIG. 6 is shown an emergency brake system for use with the present invention. This system includes a solenoid 62, in which armature 64 holds end 65 of serrated lever brake arm 66 up when there is power to the system. In the absence of power, the armature 64 will drop downward and thereby into gear-lock relationship with primary gear 22, thus preventing movement of the cable and its associated scaffolding.

While there has been shown and described the preferred embodiment of the instant invention it is to be appreciated that the invention may be embodied otherwise than is herein specifically shown and described and that, within said embodiment, certain changes may be made in the form and arrangement of the parts without departing from the underlying ideas or principles of this invention as set forth in the Claims appended herewith.

What is claimed is:

1. A cable hoist controller used with mechanized multi-story scaffolding, said controller comprising:

(a) a load-bearing support plate;

(b) a prime mover secured to said support plate, said prime mover having a rotational power output shaft in direct mechanical communication with an angular velocity modification gear;

(c) a primary gear in driven gear relationship with said velocity modification gear, said primary gear journalled to said support plate;

(d) a driving sheave having an axial width and further having a circumferential surface including a circumferential cable-receiving groove, said sheave journalled upon a common axis of rotation of both said primary gear and said sheave, said sheave secured in fixed rotational relationship with said primary gear;

(e) cable means situated within said cable-receiving groove of said sheave;

(f) a plurality of rollers, each having a circumferential cable-receiving groove and an axial width thereof, each roller of said plurality thereof having a transverse axial channel therewithin, said channel parallel with said axis of rotation of said primary gear, said plurality of rollers disposed about said circumferential surface of said driving sheave and in mechanical communication with said cable means;

(g) a plurality of linkage means comprising means for connection of each of said rollers to each other, in which at least one of said linkage means comprises means for selectably detachable removal thereof from a roller communicating therewith; and (h) an input roller at one end of said plurality of linkage means for facilitating feeding of said cable means between opposing cable receiving grooves of said sheaves and said rollers, whereby placement of said cable means between said sheave and said plurality of rollers is facilitated by removal of said at least one of said selectably detachably removable linkage means and, further whereby, traction of said cable means against said cable receiving groove of said sheave will increase as a function of the weight of the load on the load-bearing plate of the cable controller.

2. The controller as recited in claim 1, further comprising:

means for anchoring an opposite end of said plurality of linkage means to said support plate.

3. The controller as recited in claim 1, in which said prime mover comprises an electric motor.

4. The controller as recited in claim 1, in which said cable-receiving groove of said sheave defines, in radial cross-section, a triangle having an apex angle in the range of 20 to 40 degrees.

5. The controller as recited in claim 4, in which said linkage means comprise:

(i) a plurality of bar elements; and (ii) axles at each end of each pair of said plurality of bar elements, each axle extending through one of said transverse axial channels of said rollers and into opposing sides of each of said bar elements.

6. The controller as recited in claim 1, further comprising:

a positive brake comprising means for locking said driving sheaving in the absence of electric power to said controller.

7. The controller as recited in claim 6, in which said locking means comprises a solenoid.

8. The controller as recited in claim 1, in which said securing means (i) comprises a pair of removable rigid bars.

* * * * *